United States Patent [19]

Aoki et al.

[11] Patent Number: 4,954,409

[45] Date of Patent: Sep. 4, 1990

[54] DEVELOPER FOR ELECTROPHOTOGRAPHY

[75] Inventors: Takayoshi Aoki; Masayuki Takeda, both of Kanagawa, Japan

[73] Assignee: Fuji Xerox Co., Ltd., Tokyo, Japan

[21] Appl. No.: 52,817

[22] Filed: May 22, 1987

[30] Foreign Application Priority Data

| | | | |
|---|---|---|---|
| May 22, 1986 | [JP] | Japan | 61-117827 |
| May 22, 1986 | [JP] | Japan | 61-117828 |
| May 22, 1986 | [JP] | Japan | 61-117829 |
| May 22, 1986 | [JP] | Japan | 61-117830 |

[51] Int. Cl.[5] ..... G03G 9/10

[52] U.S. Cl. ..... 430/108; 430/110

[58] Field of Search ..... 430/108, 110, 137

[56] References Cited

U.S. PATENT DOCUMENTS

| | | | |
|---|---|---|---|
| 2,659,670 | 11/1953 | Copley | 430/107 |
| 2,753,308 | 7/1956 | Landrigan | 430/107 |
| 2,788,288 | 4/1957 | Rheinfrank et al. | 430/107 |
| 3,798,167 | 3/1974 | Kukla et al. | 252/62.1 |
| 3,922,381 | 11/1975 | Datta | 252/62.1 |
| 3,922,382 | 11/1975 | Kukla et al. | 427/58 |
| 4,073,980 | 2/1978 | Westdale et al. | 428/404 |
| 4,304,830 | 12/1981 | Bolte et al. | 430/107 |
| 4,378,420 | 3/1983 | Gruber et al. | 430/120 |
| 4,590,141 | 5/1986 | Aoki et al. | 430/110 |
| 4,725,521 | 2/1988 | Shigeta et al. | 430/108 |

FOREIGN PATENT DOCUMENTS

| | | |
|---|---|---|
| 1395472 | 7/1972 | Japan . |
| 9743578 | 8/1978 | Japan . |

*Primary Examiner*—John L. Goodrow

*Attorney, Agent, or Firm*—Sughrue, Mion, Zinn, Macpeak & Seas

[57] ABSTRACT

A developer for electrophotography is disclosed, which comprises a toner having a colorant and a carrier having a core material that is coated with a layer containing a polymer of a fluorinated alkyl acrylate or methacrylate, the monomer constituting less than 50 wt % of the total coating material.

14 Claims, No Drawings

DEVELOPER FOR ELECTROPHOTOGRAPHY

FIELD OF THE INVENTION

The present invention relates to a developer for use in electrophotography, particularly in electrostatic recording, as a means for rendering a latent electrostatic image visible. More particularly, the present invention relates to a developer that comprises a toner having improved negative chargeability and a positively chargeable carrier having a magnetic core material coated with a resin layer, and the carrier has improved chargeability, resistance to surface soiling, mechanical strength, and adhesion between the core and the resin coating layer.

BACKGROUND OF THE INVENTION

Electrophotographic processing is commonly performed by the following procedures: a latent electrostatic image is formed by various electrical means on a photoreceptor made of selenium or some other suitable photoconductive material; and toner particles are deposited on the latent image by a suitable method of development, such as magnetic brush method, so as to produce a visible image.

In the development step, carrier particles are used in order to impart an appropriate amount of positive or negative electrical charges to the toner. Carriers are generally divided into two types: "coated" and "uncoated". For various reasons including the life of developer used, the former type has a better performance and various kinds of "coated" carriers have so far been developed and used commercially.

While coated carriers are required to possess various characteristics, particularly important ones include appropriateness of the polarity of charges generated by electrification, high impact and wear resistance, good adhesion between the core and the coating layer, and uniformity of charge distribution. In these respects, the prior art coated carriers still have problems to be solved and an ideal product has yet to become known. Fluorine-based resins, e.g., fluorinated vinyl polymers used as coating materials as described in U.S. Pat. Nos. 3,922,382 and 3,798,167 have high resistance to surface soiling due to their low surface energy. However, they are located at an extremely negative side in the triboelectric series and are liable to be charged negatively so that they cannot charge a toner negatively, and in addition they are unable to provide strong adhesion to the magnetic core. Acrylic polymers as described in Japanese Patent Application (OPI) No. 13954/72 are satisfactory in terms of mechanical strength, adhesion to the core and positive chargeability, but, on the other hand, they are generally considered to be unsatisfactory with respect to their resistance to surface soiling. In this way, the prior art coated carriers have had to employ coating materials that have their own advantages and disadvantages.

SUMMARY OF THE INVENTION

Under these circumstances, the present inventors made extensive efforts to solve the aforementioned problems of the prior art coatings, and, as a result, it has now been found that the characteristics required of these coated carriers can be effectively improved by using a specified coating material. The present inventors also found that a developer comprising the resulting carrier and a toner having a specified charge control agent dispersed therein offers excellent results in various aspects such as image quality and the life of the developer. The present invention has been accomplished on the basis of these findings.

An object, therefore, of the present invention is to provide a novel developer for use in electrophotography, particularly in electrostatic recording, as a means of rendering a latent electrostatic image visible.

Another object of the present invention is to provide a developer that can be rapidly electrified because of the good chargeability of the toner it employs, and which is free from the problem of decrease in the amount of charge during the course of running operation because of the high resistance to surface soiling of the carrier it uses, and which, as a consequence, neither causes undesired fogging nor fouls the interior of the copying or recording machine in which it is used.

Still another object of the present invention is to provide a developer comprising a carier capable of charging a toner negatively so that it can be applied to a positively chargeable photoreceptor, with taking the advantages of fluorine-based resins used as the coating materials.

These and other objects of the present invention can be attained by using a developer comprising a toner containing a colorant and a carrier wherein the core material is coated with a specified amount of a polymer of a fluorinated alkyl acrylate or methacrylate. Stated more specifically, the present invention is directed to a developer comprising a toner having a colorant dispersed therein and a carrier, a core material of which is coated with a layer containing a polymer of a fluorinated alkyl acrylate or methacrylate, said monomer (i.e., fluorinated alkyl acrylate or methacrylate) constituting less than 50 wt % of the total coating material.

DETAILED DESCRIPTION OF THE INVENTION

The fluorinated alkyl acrylate or methacrylate in the coating material of the carrier is used in the form of a homopolymer or a copolymer. If it is in the form of a homopolymer, the homopolymer must be used in admixture with another coating material. If it is in the form of a copolymer, the use of another coating material is optional. Whichever the case, it is essential that the fluorinated alkyl acrylate or methacrylate be used in a monomeric amount of less than 50 wt % of the total coating material used and preferably 5 wt % or more, and more preferably from 10 to 40 wt %. If the content of the fluorinated alkyl acrylate or methacrylate is 50 wt % or more of the total coating material, the resulting carrier cannot be used as a positively chargeable carrier. In addition, the coating material containing such an excessive amount of fluorinated alkyl acrylate or methacrylate will suffer a marked decrease in its ability to adhere to the magnetic core material.

Illustrative fluorinated alkyl acrylates or methacrylates that can be used in the present invention include esters of acrylic acid or methacrylic acid with fluorinated alcohols preferably having from 6 to 18 carbon atoms and more preferably from 6 to 12 carbon atoms, such as 1,1-dihydroperfluoroethyl, 1,1-dihydroperfluoropropyl, 1,1-dihydroperfluorohexyl, 1,1-dihydroperfluorooctyl, 1,1-dihydroperfluorodecyl, 1,1-dihydroperfluorolauryl, 1,1,2,2-tetrahydroperfluorobutyl, 1,1,2,2-tetrahydroperfluorohexyl, 1,1,2,2-tetrahydroperfluoroocyl, 1,1,2,2-tetrahydroperfluorodecyl, 1,1,2,2-tetrahydroperfluorolauryl, 1,1,2,2-tetrahydroperfluorostearyl, 2,2,3,3-tetrafluoropropyl, 2,2,3,3,4,4-hexafluorobutyl, 1,1,ω-trihydroperfluorohexyl, 1,1,ω-trihydroperfluorooctyl, 1,1,1,3,3,3-hexafluoro-2-propyl, 3-perfluorononyl-2-acetylpropyl, 3-perfluorolauryl-2-acetylpropyl, N-perfluorohexylsulfonyl-N-methylaminoethyl, N-perfluorohexylsulfonyl-N-butylaminoethyl, N-perfluorooctylsulfonyl-N-methylaminoethyl, N-perfluorooctylsulfonyl-N-ethylaminoethyl, N-perfluorooctylsulfonyl-N-butylaminoethyl, N-perfluorodecylsulfonyl-N-methylaminoethyl, N-perfluorodecylsulfonyl-N-ethylaminoethyl, N-perfluorodecylsulfonyl-N-butylaminoethyl, N-perfluorolaurylsulfonyl-N-methylaminoethyl, N-perfluorolaurylsulfonyl-N-ethylaminoethyl, and N-perfluorolaurylsulfonyl-N-butylaminoethyl esters.

In the present invention, these fluorinated alkyl acrylates or methacrylates may be copolymerized with monomer components such as acrylic acid esters, methacrylic acid esters, nitrogen-containing vinyl monomers, styrene-based monomers, addition polymerizable unsaturated aliphatic carboxylic acids and derivatives thereof such as esters (except acrylic acid and methacrylic acid esters), amides and nitriles, aliphatic monoolefins, halogenated aliphatic olefins, and conjugated diene-based aliphatic diolefins.

Exemplary acrylic acid and methacrylic acid esters include esters of acrylic acid or methacrylic acid with alcohols such as alkyl alcohols (e.g., methyl alcohol, ethyl alcohol, propyl alcohol, butyl alcohol, amyl alcohol, hexyl alcohol, heptyl alcohol, octyl alcohol, nonyl alcohol, dodecyl alcohol, tetradecyl alcohol, and hexadecyl alcohol), alkoxyalkyl alcohols wherein these alcohols are partially alkoxylated (e.g., methoxyethyl alcohol, ethoxyethyl alcohol, ethoxyethoxyethyl alcohol, methoxypropyl alcohol, and ethoxypropyl alcohol), aralkyl alcohols (e.g., benzyl alcohol, phenylethyl alcohol, and phenylpropyl alcohol), and alkenyl alcohols (e.g., allyl alcohol and crotonyl alcohol).

Exemplary nitrogen-containing vinyl monomers include 2-vinylpyridine, 4-vinylpyridine, 2-vinyl-6-methylpyridine, 2-vinyl-5-methylpyridine, 4-butenylpyridine, 4-pentylpyridine, N-vinylpiperidine, 4-vinylpiperidine, N-vinyldihydropyridine, N-vinylpyrrole, 2-vinylpyrrole, N-vinylpyrroline, N-vinylpyrrolidine, 2-vinylpyrrolidine, N-vinyl-2-pyrrolidone, N-vinyl-2-piperidone, and N-vinylcarbazole.

Other copolymerizable monomers are specified below: styrene-based monomers including styrene and derivatives thereof such as alkyl styrenes (e.g., methyl styrene, dimethyl styrene, trimethyl styrene, ethyl styrene, diethyl styrene, triethyl styrene, propyl styrene, butyl styrene, hexyl styrene, heptyl styrene, and octyl styrene), halogenated styrenes (e.g., fluorostyrene, chlorostyrene, bromostyrene, dibromostyrene, and iodostyrene), as well as nitrostyrene, acetylstyrene, and methoxystyrene; addition polymerizable unsaturated aliphatic carboxylic acids (including mono- and dicarboxylic acids) such as α-ethylacrylic acid, crotonic acid, α-methylcrotonic acid, α-ethylcrotonic acid, isocrotonic acid, tiglic acid, and ungelicaic acid, maleic acid, fumaric acid, itaconic acid, citraconic acid, mesaconic acid, glutaconic acid, and dihydromuconic acid; esters of these addition polymerizable unsaturated aliphatic carboxylic acids with alcohols such as alkyl alcohols (e.g., methyl alcohol, ethyl alcohol, propyl alcohol, butyl alcohol, amyl alcohol, hexyl alcohol, heptyl alcohol, octyl alcohol, nonyl alcohol, dodecyl alcohol, tetradecyl alcohol, and hexadecyl alcohol), halogenated alkyl alcohols wherein these alkyl alcohols are partially hydrogenated, alkoxyalkyl alcohols (e.g., methoxyethyl alcohol, ethoxyethyl alcohol, ethoxyethoxyethyl alcohol, methoxypropyl alcohol, and ethoxypropyl alcohol), aralkyl alcohols (e.g., benzyl alcohol, phenylethyl alcohol, and phenylpropyl alcohol), and alkenyl alcohols (e.g., allyl alcohol and crotonyl alcohol); amides and nitriles derived from the aforementioned addition polymerizable unsaturated aliphatic carboxylic acids; aliphatic monoolefins such as ethylene, propylene, butene, and isobutylene; halogenated aliphatic olefins such as vinyl chloride, vinyl bromide, vinyl iodide, 1,2-dichloroethylene, 1,2-dibromoethylene, 1,2-diiodoethylene, isopropenyl chloride, isopropenyl bromide, allyl chloride, allyl bromide, vinylidene chloride, vinyl fluoride, and vinylidene fluoride; and conjugated diene-based aliphatic diolefins such as 1,3-butadiene, 1,3-pentadiene, 2-methyl 1,3-butadiene, 2,3-dimethyl-1,3-butadiene, 2,4-hexadiene, and 3-methyl-2,4-hexadiene. These copolymerizable monomers may be used either independently or in combination with themselves.

Among the comonomers listed above, positively chargeable monomers are particularly preferable for the purpose of making positively chargeable carriers and advantageous examples include the acrylic acid esters, methacrylic acid esters, and nitrogen-containing vinyl monomers described above. By using 50 wt % or more of the positively chargeable monomers based on the total coating material, the resulting coating is eased of the negative chargeability of the fluorinated alkyl acrylate or methacrylate but yet exhibits the property of low surface energy of the fluorinated alkyl acrylate or methacrylate.

Good results are attained even if the coating material of the carrier in the developer of the present invention is a random copolymer, but for the purpose of providing improved resistance to surface soiling, the coating material is preferably in the form of a graft or block copolymer.

A variety of polymers may be used as the coating material that is to be mixed with the polymer or copolymer of the fluorinated alkyl acrylate or methacrylate described above. Illustrative polymers that can be used for this purpose include polymers or copolymers of the addition polymerizable monomers listed above, as well as polyamides, polyesters, polycarbonates, silicone resins, cellulose resins and other polycondensation resins. It is particularly preferable to use polymers of the already described positively chargeable monomers in combination with the polymer or copolymer of the fluorinated alkyl acrylate or methacrylate.

Examples of the core material that can be used in the present invention include methyl methacrylate, glass, aluminum, silicon dioxide, iron oxide, carbonyl iron, flintshot, ferromagnetic materials (e.g., iron, steel, ferrite, and nickel), and mixtures thereof. The particle size of the core material is usually selected from such a range that carrier particles of from 10 to 1,000 μm, preferably from 30 to 500 μm in size (diameter) will be attained, which possesses sufficient density and inertia to avoid adherence to electrostatic images during development.

These core materials are surface-treated with the already specified polymer (or copolymer) in such a manner that a coating layer of the polymer will be formed on the surface of the core material either by chemical bonding or by adsorption. Surface treatment of the core material may be conducted by either one of the following methods: (1) dissolving one or more of the aforementioned polymers in a suitable solvent, and immersing the core material in the resulting solution, followed by removal of the solvent, drying and firing at elevated temperatures; and (2) allowing the core material to be suspended in a fluidized bed and spray-coating the already prepared polymer solution, followed by drying and firing at elevated temperatures. In both methods, the step of firing at elevated temperatures may be omitted if so desired.

The polymer coating is preferably applied in an amount of from 0.005 to 3.0 wt %, more preferably from 0.05 to 2.5 wt %, of the core material. The coating layer preferably has a thickness of from 0.05 to 5.0 μm and more preferably from 0.2 to 0.7 μm so as to protect the core material and to aid the triboelectrification of toner particles.

The carrier thus prepared is subsequently mixed with the toner described below so as to make the developer of the present invention useful for rendering a latent electrostatic image visible.

The toner to be mixed with the carrier contains a colorant and optionally a charge control agent. Useful colorants are illustrated by a variety of dyes and pigments (e.g., azo-type dyes and pigments and phthalocyanine pigments), and carbon black, and they are described, for example, in U.S. Pat. Nos. 4,304,830, 2,659,670, 2,753,308, 3,070,342, and 2,788,288. A black toner having an improved negative chargeability can be obtained by using a carbon black having a pH of 4 or less. Copper phthalocyanine or a derivative thereof may be used as the charge control agent, but a particularly effective compound is a 2:1-type metal complex salt, especially a chromium complex salt, of O,O'-dihydroxyazo dye. This type of complex salt has the following general formula:

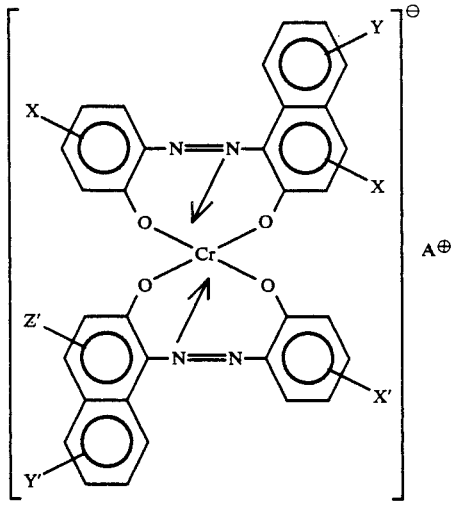

wherein X, Y, Z, X', Y', and Z' are each selected from among a hydrogen atom, an alkyl group preferably from 1 to 4 carbon atoms, an alkoxy group preferably from 1 to 4 carbon atoms, a nitro group, a halogen atom, a carbonyl group, a hydroxyl group, a sulfone group, a sulfonamide group, etc.; Z and Z' may be an atomic group that is bonded to a substituted or unsubstituted phenyl group by an amide bond; $A^{\oplus}$ is a hydrogen, alkali metal, aliphatic ammonium, or pyridinium cation.

The charge control agent may be added in an amount of 10 wt % or less and preferably up to 3 wt % based on the total weight of toner.

Any conventional binder resins may be used in the toner described above such as styrene resins, styrene/acrylic copolymers, polyolefins, polyesters, and epoxy resins, as described in U.S. Pat. Nos. 2,659,670, 2,753,308, 3,070,342, 2,788,288, etc. In particular, a toner having an improved negative chargeability can be obtained when a styrene-based monomer constitutes more than 50 wt % of the binder resin.

The toner can be prepared in a conventional manner, and the particle size of toner is generally from 5 to 30 μm and preferably from 6 to 15 μm.

The surfaces of the particles of the toner used in the present invention may be coated with the fine particles of silicon dioxide, aluminum oxide, titanium oxide, zinc stearate, and microfine resin powders that have particle sizes smaller than the average size of the toner particles.

The mixing ratio of the carrier of the present invention to the toner is not particularly limited but it is preferably from 10/1 to 200/1.

The developer of the present invention in which a carrier having a magnetic core material coated with the polymer specified above is mixed with a toner has certain advantages; e.g., it can be rapidly electrified and will yet experience no significant drop in the quantity of charge generated, so that it will not cause any premature fogging or foul the interior of the copying or recording machine in which it is used, and can thereby be used satisfactorily for an extended period of time.

The following examples are provided for the purpose of further illustrating the present invention, but are in no sense to be taken as limiting.

EXAMPLE 1

Ten parts by weight of a polymer composed of 20 parts by weight of N-perfluorooctylsulfonyl-N-methylaminoethyl methacrylate, 65 parts by weight of methyl methacrylate and 15 parts by weight of styrene was dissolved in 100 parts by weight of methyl ethyl ketone. Using a fluidized bed coating apparatus, the resulting solution was coated on 2,000 parts by weight of ferrite particles having an average size of 100 μm, so as to make a carrier.

In a separate step, 90 parts by weight of a polymer composed of 80 parts by weight of styrene and 20 parts by weight of butyl acrylate, 8 parts by weight of carbon black ("Cabot BP-1300" produced by Cabot Co.; pH=2.5) and 2 parts by weight of a chromium complex salt of O,O'-dihydroxyazo dye ("AIZEN SPILON BLACK TRH," produced by Hodogaya Chemical Co., Ltd.) were blended with a pressure kneader. After cooling, the mix was ground into particles, first with a hammer mill, then with a jet mill. The particles were classified to obtain toner particles that had an average size of 11 μm.

Three parts by weight of the toner was mixed with 100 parts by weight of the previously prepared carrier to make a developer.

EXAMPLE 2

Ten parts by weight of a polymer composed of 55 parts by weight of a methacrylic acid ester of 1,1,2,2-tetrahydroperfluorodecyl alcohol, 44 parts by weight of methyl methacrylate and 1 part by weight of 4-vinylpyridine, and 5 parts by weight of polymethyl methacrylate were dissolved in 150 parts by weight of methyl ethyl ketone. Usin a fluidized bed coating apparatus, the resulting solution was coated on 2,000 parts by weight of ferrite particles having an average size of 60 μm, so as to make a carrier.

One hundred parts by weight of this carrier was mixed with 3.5 parts by weight of the toner prepared as in Example 1, so as to make a developer.

EXAMPLE 3

Ten parts by weight of a polymer composed of 20 parts by weight of an acrylic acid ester of 1,1,2,2-tetrahydroperfluorohexyl alcohol, 75 parts by weight of methyl methacrylate and 5 parts by weight of 2-vinylpyridine was dissolved in 200 parts by weight of xylene. Using a fluidized bed coating apparatus, the resulting solution was coated on 1,500 parts by weight of ferrite particles having an average size of 100 μm to make a carrier.

In a separate step, 88 parts by weight of a polymer composed of 60 parts by weight of styrene and 40 parts by weight of butyl methcarylate, 10 parts by weight of carbon black (Cabot BP-1300) and 2 parts by weight of a chromium complex salt of O,O'-dihydroxyazo dye (AIZEN SPILON BLACK TRH) were blended with a pressure kneader. After cooling, the mix was ground into particles first with a hammer mill, then with a jet mill. The particles were classified to obtain toner particles that had an average size of 11 μm.

Three parts by weight of this toner was mixed with 100 parts by weight of the previously prepared carrier to make a developer.

EXAMPLE 4

Ten parts by weight of a polymer composed of 10 parts by weight of a methacrylic acid ester of 1,1,2,2-tetrahydroperfluorohexyl alcohol, 89 parts by weight of ethyl methacrylate and 1 part by weight of methacrylic acid was coated on 2,000 parts by weight of spherical iron oxide particles (average size: 80 μm) as in Example 3 to make a carrier.

One hundred parts by weight of this carrier was mixed with 3 parts by weight of the toner prepared as in Example 3 to make a developer.

EXAMPLE 5

Ten parts by weight of a polymer composed of N-perfluorooctylsulfonyl-N-propylaminoethyl methacrylate in side chains and ethyl acrylate in the main chain (10/90 in weight ratio) was dissolved in 200 parts by weight of methyl ethyl ketone. Using a fluidized bed coating apparatus, the resulting solution was coated on 1,000 parts by weight of spherical ferrite particles having an average size of 100 μm, so as to make a carrier.

In a separate step, 90 parts by weight of a polymer composed of 80 parts by weight of styrene and 20 parts by weight of butyl acrylate, and 8 parts by weight of carbon black (Cabot BP-1300) were blended with a pressure kneader. After cooling, the mix was ground into particles, first with a hammer mill, then with a jet mill. The particles were classified to make toner particles that had an average size of 11 μm.

Three parts by weight of this toner was mixed with 100 parts by weight of the previously prepared carrier so as to make a developer.

COMPARATIVE EXAMPLE

Another control carrier was made by repeating the same procedures as employed in Example 5 except that no fluorinated alkyl methacrylate was used and that a homopolymer of ethyl methacrylate was used.

One hundred parts by weight of this carrier was mixed with 3 parts by weight of the toner prepared as in Example 5, so as to make a comparative developer.

EXAMPLE 6

Two parts by weight of a first polymer composed of 40 parts by weight of N-perfluorohexylsulfonyl-N-butylaminoethyl acrylate, 20 parts by weight of styrene, 38 parts by weight of methyl methacrylate and 2 parts by weight of methacrylic acid, and 8 parts by weight of a second polymer composed of 85 parts by weight of methyl methacrylate and 15 parts by weight of styrene were dissolved in 100 parts by weight of toluene. Using a fluidized bed coating apparatus, the resulting solution was coated on 1,500 parts by weight of spherical iron oxide particles having an average size of 100 μm, so as to make a carrier.

One hundred parts by weight of this carrier was mixed with 3 parts by weight of the toner prepared as in Example 1 so as to make a developer.

EXAMPLE 7

Two parts by weight of a first polymer composed of 60 parts by weight of N-perfluorooctylsulfonyl-N-propylaminoethyl methylacrylate and 40 parts by weight of methyl methacrylate and 12 parts by weight of a second polymer composed of 90 parts by weight of methyl methacrylate, 7 parts by weight of dibutyl furamate and 3 parts by weight of vinylcarbazole were treated in entirely the same manner as employed in Example 6, so as to make a carrier.

One hundred parts by weight of this carrier was mixed with 2 parts by weight of the toner prepared as in Example 1 so as to make a developer.

The thus prepared developers were subjected to a continuous copying test with a Fuji Xerox 4370 copying machine, and the results are summarized in the following Table.

The quantity of electrical charges is a triboelectric value generated by contact of the carrier particles with the toner particles measured by means of a Faraday Cage. This device comprises a stainless steel cylinder having a diameter of about 1 inch and a length of about 1 inch. A screen is positioned at each end of the cylinder; the screen openings are of such a size as to permit the toner particles to pass through the openings but prevent the carrier particles from making such passage. The Faraday Cage is weighed, charged with about 0.5 gram of the carrier particles and toner particles, reweighed, and connected to the input of a coulomb meter. Dry compressed air is then blown through the cylinder to drive all the toner particles from the carrier particles. As the electrostatically charged toner particles leave the Faraday Cage, the oppositely charged carrier particles cause an equal amount of electronic charge to flow from the Cage, through the coulomb meter, to ground. The coulomb meter measures this charge which is then taken to be the charge on the toner which was removed. Next, the cylinder is reweighed to determine the weight of the toner removed. The resulting data are used to calculate the average charge to mass ratio of the toner particles.

The separation of the coating material from the core material was examined by scanning electron micrography. The stickiness of toner to the surface of carrier particles was measured in terms of the amount (mg) of toner adhered on the surface of carrier particles, which was not removed with an aqueous solution of surfactant, per 100 g of carrier particles after $10^5$ runs. The life of developer was judged to have ended when the image density had dropped to 0.7 or below (relative to the reference of 1.0) and the density of the background increased to 0.03 or more.

TABLE

| Example | Quantity of charges initial (μc/g) | Quantity of charges after $10^5$ runs (μc/g) | Fouling of the interior of copying machine | Separation of coating material | Stickiness of toner relative to carrier particles (mg) | Life |
|---|---|---|---|---|---|---|
| 1 | −12 | −10 | none | negligible | <500 | $>10^5$ runs |
| 2 | −18 | −20 | none | negligible | <500 | $>10^5$ runs |
| 3 | −15 | −15 | none | negligible | <500 | $>10^5$ runs |
| 4 | −20 | −16 | none | negligible | <500 | $>10^5$ runs |
| 5 | −22 | −15 | none | negligible | <500 | $>10^5$ runs |
| Comp. Ex. | −16 | −4 | detected | negligible | >600 | $2 \times 10^4$ runs |
| 6 | −15 | −17 | none | negligible | <500 | $>10^5$ runs |
| 7 | −18 | −20 | none | negligible | <500 | $>10^5$ runs |

While the invention has been described in detail and with reference to specific embodiments thereof, it will be apparent to one skilled in the art that various changes and modifications can be made therein without departing from the spirit and scope thereof.

What is claimed is:

1. A developer comprising a negatively chargeable toner having a colorant dispersed in a binder resin and a carrier having a core material that is coated with a layer containing a polymer of a fluorinated alkyl acrylate or methacrylate, said binder resin being composed of more than 50 wt % of a styrene-based monomer as a monomer component, and said fluorinated alkyl acrylate or methacrylate constituting less than 50 wt % of the total coating material.

2. A developer according to claim 1 wherein said toner further contains a chromium complex salt of O,O'-dihydroxyazo dye.

3. A developer according to claim 1, wherein said polymer is a copolymer of a fluorinated alkyl acrylate or methacrylate with a positively chargeable monomer.

4. A developer according to claim 1, wherein said positively chargeable monomer is at least one member selected from the group consisting of an acrylic acid ester, a methacrylic acid ester and a nitrogen-containing vinyl monomer.

5. A developer according to claim 1, wherein said polymer is a graft or block copolymer of a fluorinated alkyl acrylate or methacrylate.

6. A developer according to claim 1, wherein said coating layer comprises a polymer of a fluorinated alkyl acrylate or methacrylate and a polymer of a positively chargeable monomer.

7. A developer according to claim 6, wherein said positively chargeable monomer is at least one member selected from the group consisting of an acrylic ester, a methacrylic acid ester, and a nitrogen-containing vinyl monomer.

8. A developer according to claim 1, wherein said monomer constitutes from 5 to 50 wt % of the total coating material.

9. A developer according to claim 8, wherein said monomer constitutes from 10 to 40 wt % of the total coating material.

10. A developer according to claim 1, wherein said fluorinated alkyl acrylate or methacrylate is an ester of acrylic or methacrylic acid with a fluorinated alcohol having from 6 to 18 carbon atoms.

11. A developer according to claim 1, wherein said polymer coating is applied in an amount of from 0.05 to 3.0 wt % of the core material.

12. A developer according to claim 1, wherein said polymer coating is applied in an amount of from 0.05 to 2.5 wt % of the core material.

13. A developer according to claim 1, wherein the polymer coating thickness is in the range of from 0.5 to 5.0 μm.

14. A developer according to claim 1, wherein said colorant is a carbon black having a pH of 4 or less.

* * * * *